US009517628B2

(12) United States Patent
Tenkawa et al.

(10) Patent No.: US 9,517,628 B2
(45) Date of Patent: Dec. 13, 2016

(54) PRINTING APPARATUS, METHOD, AND NON-TRANSITORY STORAGE MEDIUM

(71) Applicant: CANON KABUSHIKI KAISHA, Tokyo (JP)

(72) Inventors: Tomoyuki Tenkawa, Yokohama (JP); Atsushi Takahashi, Tama (JP); Kei Kosaka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/815,151

(22) Filed: Jul. 31, 2015

(65) Prior Publication Data

US 2016/0052276 A1 Feb. 25, 2016

(30) Foreign Application Priority Data

Aug. 25, 2014 (JP) ..... 2014-170892

(51) Int. Cl.
*B41J 2/165* (2006.01)
*B41J 2/175* (2006.01)

(52) U.S. Cl.
CPC ..... *B41J 2/16508* (2013.01); *B41J 2/16517* (2013.01); *B41J 2/16532* (2013.01); *B41J 2/17566* (2013.01); *B41J 2002/16573* (2013.01)

(58) Field of Classification Search
CPC ..... B41J 2/16532
See application file for complete search history.

(56) References Cited

U.S. PATENT DOCUMENTS

2003/0112286 A1* 6/2003 Shindo ..... B41J 2/1652 347/30
2005/0068364 A1* 3/2005 Kayanaka ..... B41J 2/165 347/23
2010/0231641 A1* 9/2010 Danzuka ..... B41J 2/16532 347/30
2013/0100200 A1 4/2013 Hamasaki et al.
(Continued)

FOREIGN PATENT DOCUMENTS

JP EP 0552472 A2 * 7/1993 ..... B41J 2/1652
JP 2000-296627 A 10/2000
(Continued)

OTHER PUBLICATIONS

U.S. Appl. No. 14/829,000 to Kei Takarabe, et al., filed Aug. 18, 2015.
(Continued)

*Primary Examiner* — Shelby Fidler
(74) *Attorney, Agent, or Firm* — Fitzpatrick, Cella, Harper & Scinto

(57) ABSTRACT

A printing apparatus comprises an ink tank containing ink, a sub-tank containing the ink supplied from the ink tank, a printhead discharging the ink supplied from the sub-tank, a detection unit configured to perform a detection operation of detecting an ink remaining amount of the sub-tank, a suction unit configured to perform a suction operation of sucking the ink from the printhead, and a control unit configured to stop the suction unit from performing the suction operation when the detection unit detects that the ink remaining amount becomes smaller than a predetermined residual amount during execution of the suction operation.

18 Claims, 10 Drawing Sheets

(56) References Cited

U.S. PATENT DOCUMENTS

| | | | | |
|---|---|---|---|---|
| 2015/0097882 | A1* | 4/2015 | Uchiyama | B41J 2/165 347/6 |
| 2015/0183220 | A1 | 7/2015 | Shiiba et al. | |

FOREIGN PATENT DOCUMENTS

| | | | |
|---|---|---|---|
| JP | 2003-94686 | A | 4/2003 |
| JP | 4192500 | B2 | 12/2008 |
| JP | 2009-23329 | A | 2/2009 |

OTHER PUBLICATIONS

U.S. Appl. No. 14/828,981 to Osamu Iwasaki, et al., filed Aug. 18, 2015.

* cited by examiner

PRINTING APPARATUS, METHOD, AND NON-TRANSITORY STORAGE MEDIUM

BACKGROUND OF THE INVENTION

1. Field of the Invention

The present invention relates to a printing apparatus, method and non-transitory storage medium.

2. Description of the Related Art

In a printing apparatus typified by an inkjet printing apparatus, clogging of ink orifices is prevented by performing, for example, a suction operation of sucking ink from the ink orifices of a printing unit, in order to maintain the performance of the printing unit. If the suction operation is performed in a state in which the ink remaining amount is small, ink runs out during suction, air in an ink tank is guided to an ink supply channel, and bubbles may be trapped in the supply channel. The bubbles cause a discharge failure when discharging ink. Japanese Patent Laid-Open No. 2000-296627 discloses a technique of inhibiting the suction operation in a state in which the ink remaining amount in the ink tank is small.

However, if the suction operation is inhibited because of a small ink remaining amount, unused ink may remain in the ink tank. If the ink tank is exchanged in this state, unused ink remaining in the ink tank is wasted.

SUMMARY OF THE INVENTION

The present invention provides a technique of decreasing the residual ink amount of unused ink in an ink tank.

According to an aspect of the present invention, there is provided a printing apparatus comprising: an ink tank containing ink; a sub-tank containing the ink supplied from the ink tank; a printhead discharging the ink supplied from the sub-tank; a detection unit configured to perform a detection operation of detecting an ink remaining amount of the sub-tank; a suction unit configured to perform a suction operation of sucking the ink from the printhead; and a control unit configured to stop the suction unit from performing the suction operation when the detection unit detects that the ink remaining amount becomes smaller than a predetermined residual amount during execution of the suction operation.

According to another aspect of the present invention, there is provided a method of controlling a printing apparatus including an ink tank containing ink, a sub-tank containing the ink supplied from the ink tank, and a printhead discharging the ink supplied from the sub-tank, the method comprising: detecting an ink remaining amount of the sub-tank; performing a suction operation of sucking the ink from the printhead, based on a detection result of the detecting; and stopping the suction operation based on a detection result representing that the ink remaining amount becomes smaller than a predetermined residual amount during execution of the suction operation.

According to still another aspect of the present invention, there is provided a non-transitory storage medium storing a program for causing a computer of a printing apparatus including an ink tank containing ink, a sub-tank containing the ink supplied from the ink tank, and a printhead discharging the ink supplied from the sub-tank, to execute the program, the program comprising: causing a sensor to detect an ink remaining amount of the sub-tank; causing a suction unit to perform a suction operation of sucking the ink from the printhead, based on a detection result of the causing a sensor to detect; and causing the suction unit to stop the suction operation based on a detection result representing that the ink remaining amount becomes smaller than a predetermined residual amount during execution of the suction operation.

Further features of the present invention will become apparent from the following description of exemplary embodiments (with reference to the attached drawings).

DESCRIPTION OF THE EMBODIMENTS

First Embodiment

A printing apparatus 1 according to an embodiment of the present invention will be described with reference to FIGS. 1A to 3B. This embodiment will explain a case in which the present invention is exemplarily applied to a serial inkjet printing apparatus.

Note that the term "printing" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans. Also, sheet-like paper is assumed as a "printing medium" in this embodiment, but cloth, plastic film, and the like may be used as printing media. Furthermore, the term "ink" (to be also referred to as a "liquid" hereinafter) should be extensively interpreted similar to the definition of "print" described above. That is, "ink" includes a liquid which, when applied onto a printing medium, can form images, figures, patterns, and the like, can process the printing medium, or can process ink (for example, solidification or insolubilization of a coloring material in ink applied to a printing medium).

<Overall Arrangement of Printing Apparatus 1>

Figure 1A:
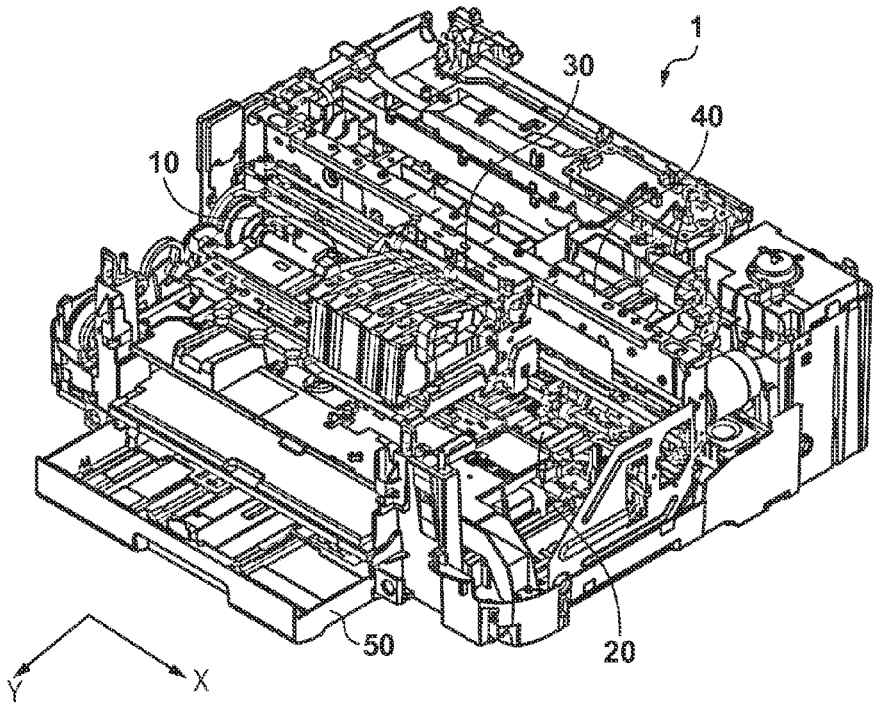
FIG. 1A is a schematic view showing a printing apparatus according to an embodiment of the present invention.

FIG. 1A is a schematic view showing the internal mechanism of the printing apparatus 1 according to this embodiment. In FIG. 1A, arrows X and Y indicate directions perpendicular to each other. The printing apparatus 1 includes a printing unit 10, a recovery unit 20, a carriage 30, a support rail 40, and a feeding device (not shown). The printing unit 10 includes a printhead 14 (see FIG. 2B) in which a plurality of orifices for discharging inks of respective colors are formed. The printing unit 10 discharges ink onto a printing medium to print an image. A surface in which the ink orifices are formed will be called an ink discharge surface 13 (see FIG. 2B). In this embodiment, the printhead 14 is arranged on the lower surface of the printing unit 10, forming the ink discharge surface 13. The printing unit 10 is mounted on the carriage 30. Note that the printing unit 10 and the carriage 30 may be integrated or separated. When the printing unit 10 and the carriage 30 are integrated, an overall member including the printing unit 10 is sometimes called a carriage. The carriage 30 is supported by the support rail 40 so that it can reciprocate in directions indicated by the arrow X. The printing unit 10 can therefore reciprocate in the X direction on the support rail 40. Note that the X direction is also called a main scanning direction. The Y direction is a printing medium conveyance direction and is also called a sub-scanning direction. A feeding tray 50 is provided on the bottom surface of the printing apparatus 1. Printing media stacked in the feeding tray 50 are fed by the feeding device (not shown). The feeding side in the printing medium conveyance direction is sometimes called the upstream side, and the discharge side is sometimes called the downstream side.

<Recovery Unit 20>

Figure 1B:
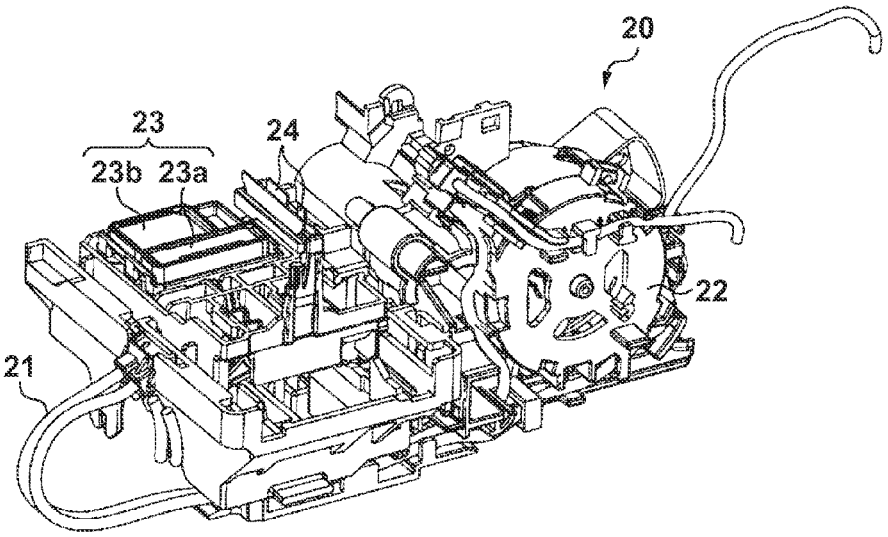
FIG. 1B is a schematic view showing the recovery unit of the printing apparatus.

FIG. 1B is an enlarged view showing in detail the main part of the recovery unit 20. The recovery unit 20 performs a recovery operation for the orifices and ink supply channels of the printing unit 10, including suction, preliminary discharge, and wiping, in order to maintain the performance of the printing unit 10. As shown in FIG. 1A, the recovery unit 20 is provided on one end portion side (right end portion in the X direction) of the support rail 40 of the printing apparatus 1. When the printing unit 10 requires a recovery operation, the printing unit 10 moves to above the recovery unit 20 along the support rail 40. Referring again to FIG. 1B, the recovery unit 20 includes a tube 21, a tube pump 22, a cap 23, and a wiper blade 24. The tube 21 has one end connected to the tube pump 22, and the other end connected to the cap 23. The tube pump 22 can generate a negative pressure inside the tube 21.

The cap 23 performs capping to cover the ink discharge surface 13 having the orifices of the printing unit 10 in order to protect the printhead 14 of the printing unit 10 at the time of non-printing, and reduce ink evaporation from the orifices of the printhead 14. In this embodiment, the cap 23 includes a Bk cap 23*a* for a Bk printhead 14*a* (to be described later), and a Col cap 23*b* for a Col printhead 14*b* (to be described later). In the explanation of this embodiment, when both the Bk cap 23*a* and Col cap 23*b* are explained, they are sometimes used as the cap 23 for the explanation.

The recovery operation is, for example, an operation (suction mentioned above) of sucking ink from the orifices in order to prevent clogging of the ink orifices of the printhead 14. In this suction operation, the cap 23 covers the ink discharge surface 13 of the printing unit 10, and bubbles or high-viscosity ink is sucked and discharged via the orifices by a negative pressure in the tube 21 that is generated by driving the tube pump 22. By doing so, the orifices of the printing unit 10 are maintained in a good ink discharge state. For example, when printing is resumed after the printing apparatus is not used for a long period, the recovery unit 20 can suck ink from the orifices of the printing unit 10 to remove high-viscosity ink. The ink sucked by the recovery unit 20 is discharged from the recovery unit 20 and held in a waste ink holding unit (not shown) provided in the printing apparatus 1. Note that the Bk cap 23*a* and the Col cap 23*b* in the cap 23 can simultaneously perform the suction operation by the negative pressure inside the tube 21. When separate tubes 21 are arranged for the Bk cap 23*a* and the Col cap 23*b*, respectively, the suction operation can be performed separately for the respective caps 23*a* and 23*b*.

As the tube pump 22, a well-known tube pump is usable. An example is the tube pump 22 configured to generate a negative pressure in the tube 21 while squashing the tube by a roller. Pressurization to the tube 21 by the roller can be canceled by a cam mechanism or the like. The roller position can be detected by, for example, a sensor, and the driving rotational speed of the tube pump 22 or the like can be detected from the roller position. The amount of ink sucked via the cap 23 can also be estimated from the driving rotational speed of the tube pump 22 (to be described later). Note that the detection of the driving rotational speed of the tube pump 22 is, for example, detection of the rotational speed of a motor serving as a driving source by a sensor such as an encoder, or detection from the control signal of the motor or the like.

As the above-described recovery operation, preliminary discharge of discharging ink from the orifices of the printhead 14 into the cap 23 is performed. "Preliminary discharge" in this specification is an operation of discharging ink by ink discharge from the printing unit 10, and aims to discharge high-viscosity or color-mixed ink. An ink absorber is arranged inside the cap 23 and absorbs preliminarily discharged ink. Wiping as one of the above-mentioned recovery operations is an operation of wiping the printhead 14 of the printing unit 10 by the wiper blade 24 serving as a plate-like member.

<Printing Unit 10>

Figure 2A:
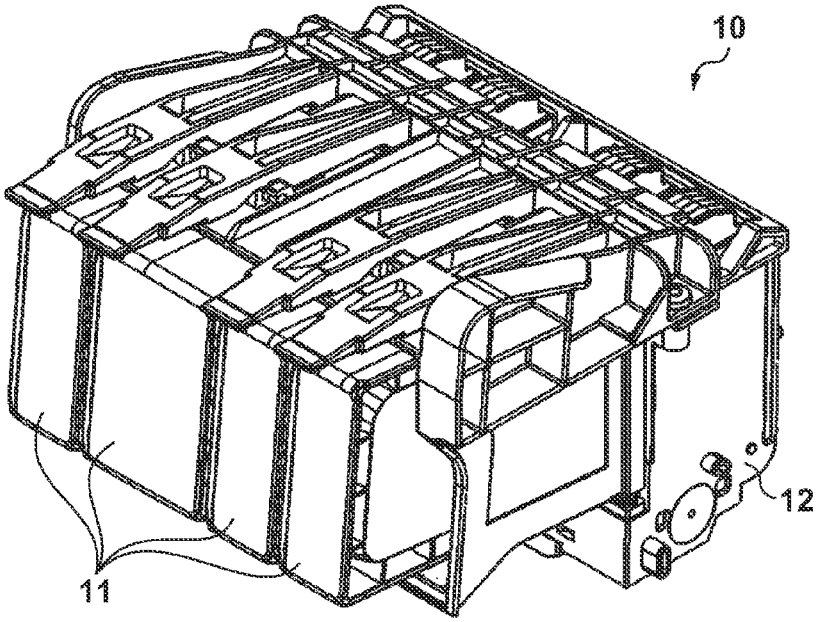
FIGS. 2A and 2B are perspective views showing a printing unit.
Figure 2B:
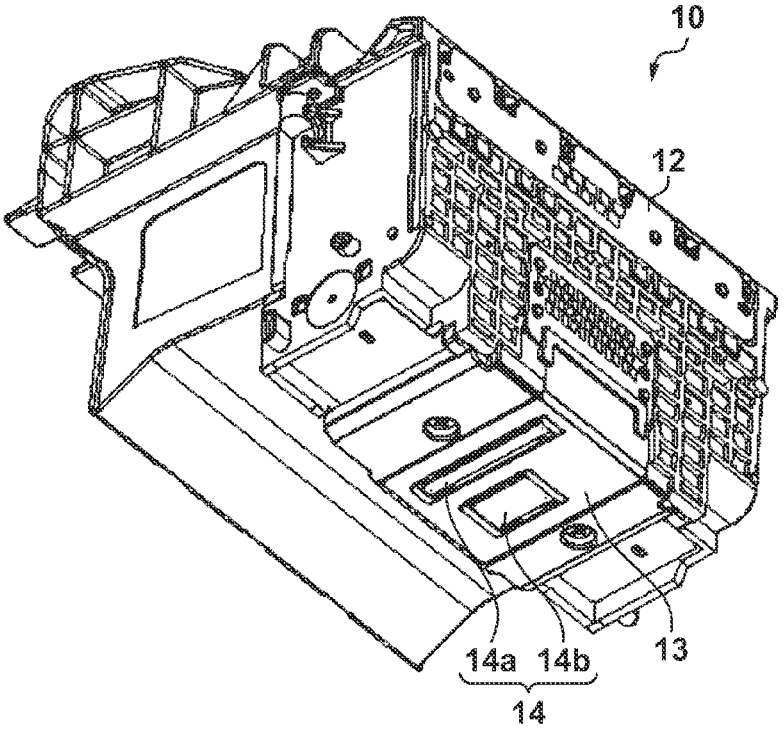

FIGS. 2A and 2B are enlarged views showing in detail the main part of the printing unit 10. FIG. 2A is an enlarged perspective view showing the printing unit 10 in the state shown in FIG. 1A. FIG. 2B is a perspective view showing the printing unit 10 when viewed from the printhead 14 provided on the lower surface of the printing unit 10. Ink tanks 11 are attached to the printing unit 10. As the ink tanks 11 that contain inks, the independent ink tanks 11 respectively for pigment inks of four, yellow (Y), black (Bk), cyan (C), and magenta (M) are prepared. Each ink tank 11 supplies ink to the printing unit 10 for each ink type. Each ink tank 11 may be detachable from a main body 12 of the printing unit 10. Although this embodiment has exemplified pigment inks of the four colors, the color type is not limited to the four colors. Further, the ink type is not limited to pigment ink and for example, dye ink can also be employed.

Referring to FIG. 2B, an ink discharge surface 13 for spraying ink droplets onto a printing medium is formed on the lower surface of the main body 12. The printheads 14 for discharging Y, Bk, C, and M inks, respectively, are provided on the ink discharge surface 13. The printheads 14 are aligned in a direction parallel to the paper conveyance direction for the respective colors. In this embodiment, the printheads 14 include the Bk printhead 14*a* for the Bk ink, and the Col printhead 14*b* for the Y, C, and M inks. In the explanation of this embodiment, when both the Bk printhead 14*a* and the Col printhead 14*b* are explained, they are sometimes used as the printhead 14 for the explanation. An electrothermal transducer (not shown) is provided inside each orifice in correspondence with the orifice. Heat generated by the electrothermal transducer causes film boiling in ink, and ink can be discharged from a corresponding orifice by the bubbling energy at this time.

Figure 3A:
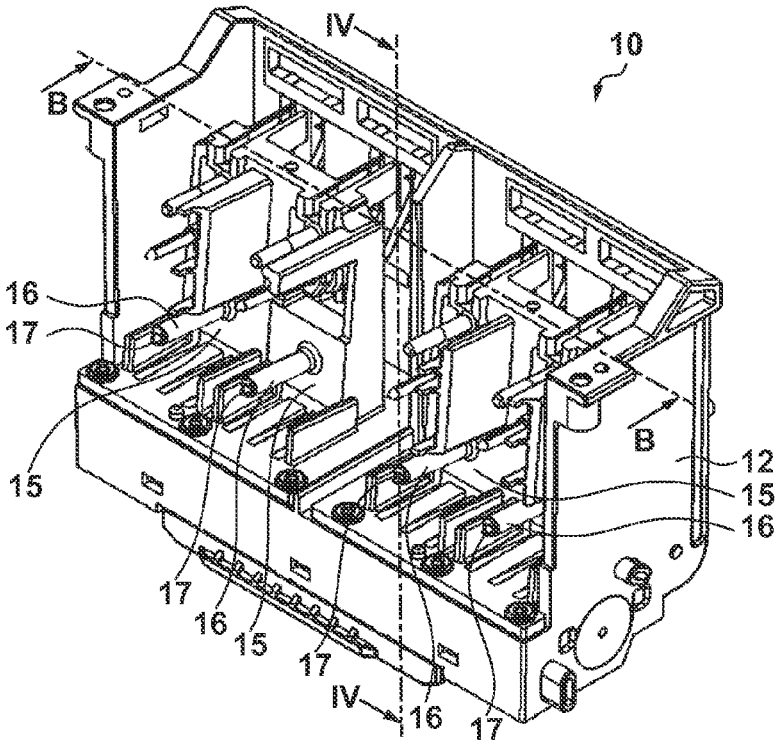
FIG. 3A is a perspective view showing the printing unit when no ink tank is mounted.
Figure 3B:
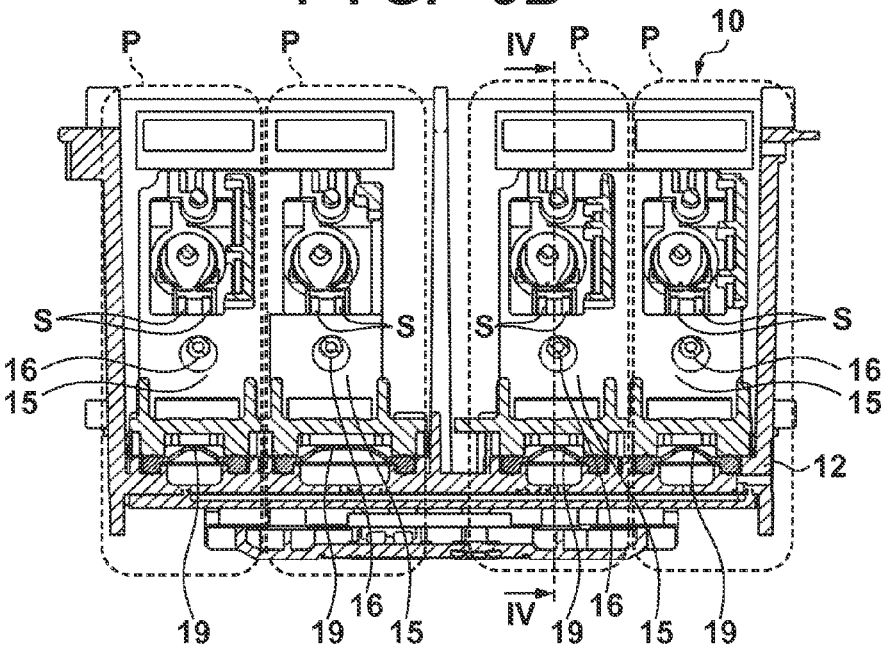
FIG. 3B is a sectional view showing the printing unit when no ink tank is mounted.

FIG. 3A is a perspective view showing the main body 12 in a state in which a member for holding the ink tank 11 is detached from the printing unit 10. FIG. 3B is a sectional view taken along a line B-B in FIG. 3A. In the main body 12, sub-tanks 15 fixed to the main body 12, and ink supply ports 16 are provided in four respective partitions P in correspondence with the four color inks employed in this embodiment. Each ink supply port 16 is a hollow member and has an opening 17 at its distal end. Each ink supply port 16 is connected to the corresponding sub-tank 15, and the opening 17 and the sub-tank 15 communicate with each other. In this embodiment, therefore, the sub-tanks 15 for the four colors are arranged side by side in the main scanning direction in correspondence with the ink tanks 11 for the four colors. That is, in this embodiment, ink is contained at two portions, that is, the ink tank 11 and the sub-tank 15 for ink of each color.

<Arrangement of Sub-Tank 15>

Figure 4:
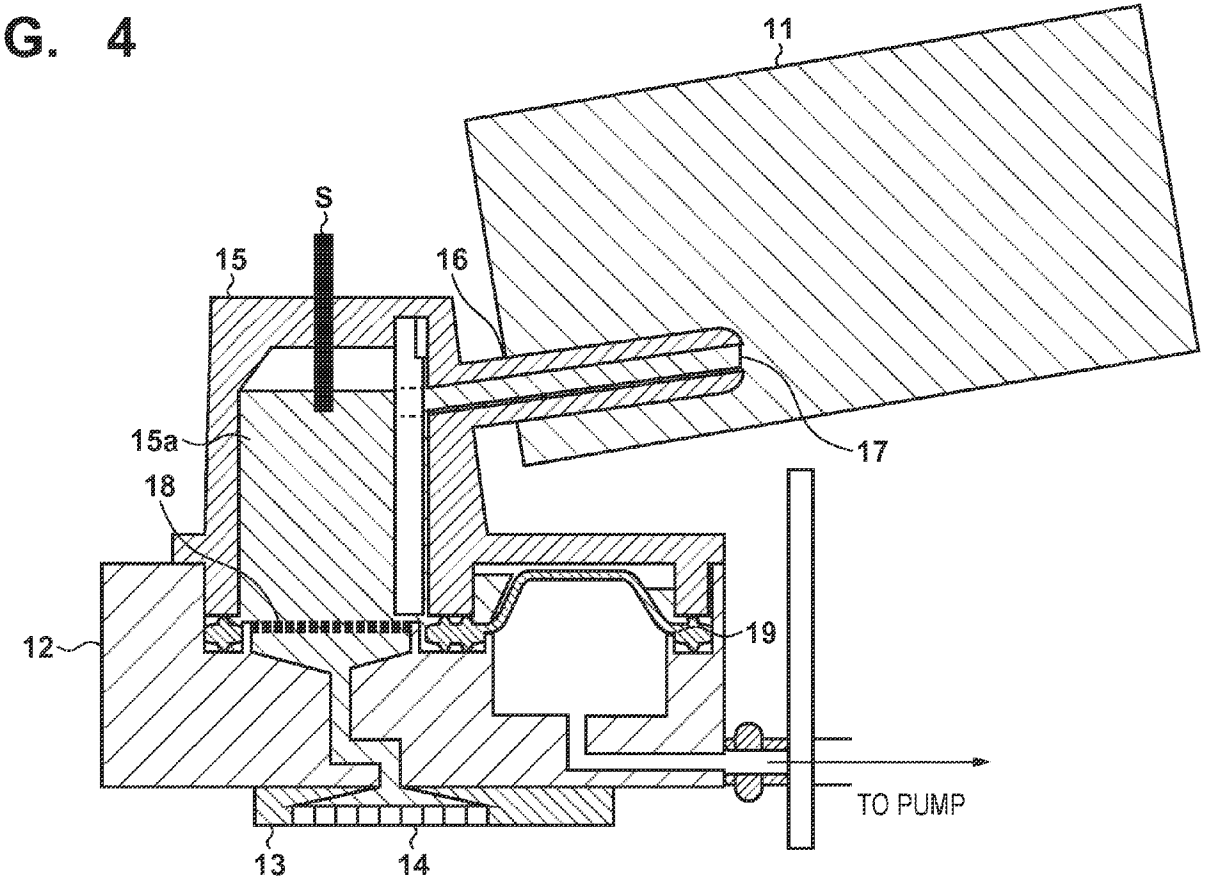
FIG. 4 is a schematic sectional view showing the printing unit.

The sub-tank 15 will be explained with reference to FIG. 4. FIG. 4 corresponds to a section IV-IV in FIGS. 3A and 3B, and is a schematic sectional view for mainly explaining the arrangement of the sub-tank 15. FIG. 4 shows a state in which the ink tank 11 is attached to the ink supply port 16 connected to the sub-tank 15. An opening capable of inserting the ink supply port 16 is formed in the ink tank 11. By inserting the ink supply port 16 into the opening, the sub-tank 15 is filled with ink in the ink tank 11 via the ink supply portion 16 from the opening 17 at the distal end of the ink supply port 16. An ink chamber 15*a* that temporarily stores ink is formed inside the sub-tank 15. The supplied ink is supplied into the main body 12 via the ink chamber 15*a*. A filter 18 is formed in the ink inflow port of the printhead 14 inside the main body 12. The ink having passed through the filter 18 is supplied to a printing element substrate on which electrothermal transducers are provided, and is discharged from the printhead 14.

Note that the ink supply port 16 is inserted into the lower portion of the ink tank 11 in FIG. 4, and the ink tank 11 is arranged at a position higher than the filter 18 in the ink inflow port of the printhead 14. Hence, ink in the ink tank 11 is supplied by its own weight from the ink tank 11 to the sub-tank 15. A chamber partitioned by a flexible member 19 is provided to be adjacent to the ink chamber 15*a* of the sub-tank 15. A chamber above the flexible member 19 in this chamber communicates with the ink chamber 15*a*. For example, when introducing ink into the ink chamber 15*a* in the empty state of the sub-tank 15, a pump (not shown) that communicates with a chamber below the flexible member 19 is driven. Then, air in this chamber is exhausted to generate a negative pressure in the chamber above the flexible member 19, thereby introducing ink into the ink chamber 15*a*.

<Detection of Ink Remaining Amount in Sub-Tank 15>

The sub-tank 15 includes a sensor S used for a detection operation of detecting an ink remaining amount in the ink chamber 15*a*. This embodiment adopts the remaining ink detection sensor S capable of detecting that the ink remaining amount in the ink chamber 15*a* becomes equal to or smaller than a predetermined residual amount. As shown in FIGS. 3B and 4, two electrode pins are arranged side by side in the main scanning direction above the ink chamber 15*a*, and the sensor S is inserted vertically. Each electrode pin is formed so that one end projects into the ink chamber 15*a* and the other end projects from the upper end portion of the sub-tank 15. The sensor S is electrically connected to the main body of the printing apparatus 1. The printing apparatus 1 obtains, for example, a voltage, which is a potential difference, as electrical information from the sensor S, and compares the electrical information with a threshold serving as a reference value to determine the presence/absence of the ink remaining amount.

The remaining ink detection sensor S is configured to be able to detect an ink remaining amount in the ink chamber 15*a* by, for example, applying an AC voltage to measure a voltage between the electrodes and compare the voltage with a threshold. For example, when the voltage is lower than the threshold, it is determined that ink exceeding a desired amount is ensured inside the ink chamber 15*a*. To the contrary, when the voltage is equal to or higher than the threshold, it is determined that the ink amount becomes equal to or lower than the desired ink remaining amount. Most of inks used for image formation are often conductive liquids, whereas air in the ink chamber 15*a* is insulating. Thus, by applying an electrical signal to the electrode pin, determination of the remaining amount becomes possible. The voltage acquisition method is not limited to the AC voltage, and a DC voltage may be used. As the sensor that detects an ink amount in the sub-tank 15, an arrangement in which the position of the liquid level is optically detected is also usable. The sensor S is not limited to the above-described one, and a well-known remaining ink detection sensor is usable.

By recognizing an ink remaining amount in the ink chamber 15*a* in this manner, the timing when the ink tank 11 needs to be exchanged can be displayed to the user. Also, by recognizing an ink remaining amount in the ink chamber 15*a*, a control unit 60 (see FIG. 5: to be described later) in the printing apparatus 1 can determine an appropriate timing to execute the above-described recovery operation.

In this embodiment, the ink remaining amount can also be detected by a so-called dot counter, in addition to the sensor S. The dot counter can be implemented by the control unit 60. The dot counter is a counter that counts the amount of ink discharged from the orifice array of the printhead 14. The ink discharged from the orifice array of the printhead 14 includes ink discharged from the printhead 14, and ink that is sucked and discharged. The dot counter counts a suction & discharge amount, or a value obtained by multiplying the number of discharged ink droplets by the volume of one droplet. Further, the ink tank 11 can include a memory that stores the ink remaining amount. This memory facilitates management of the ink remaining amount before and after the ink tank 11 is attached/detached. In addition, mounting/dismounting of the ink tank on/from the printing apparatus can also be detected by accessing this memory by the control unit 60.

<Control Unit>

Figure 5:
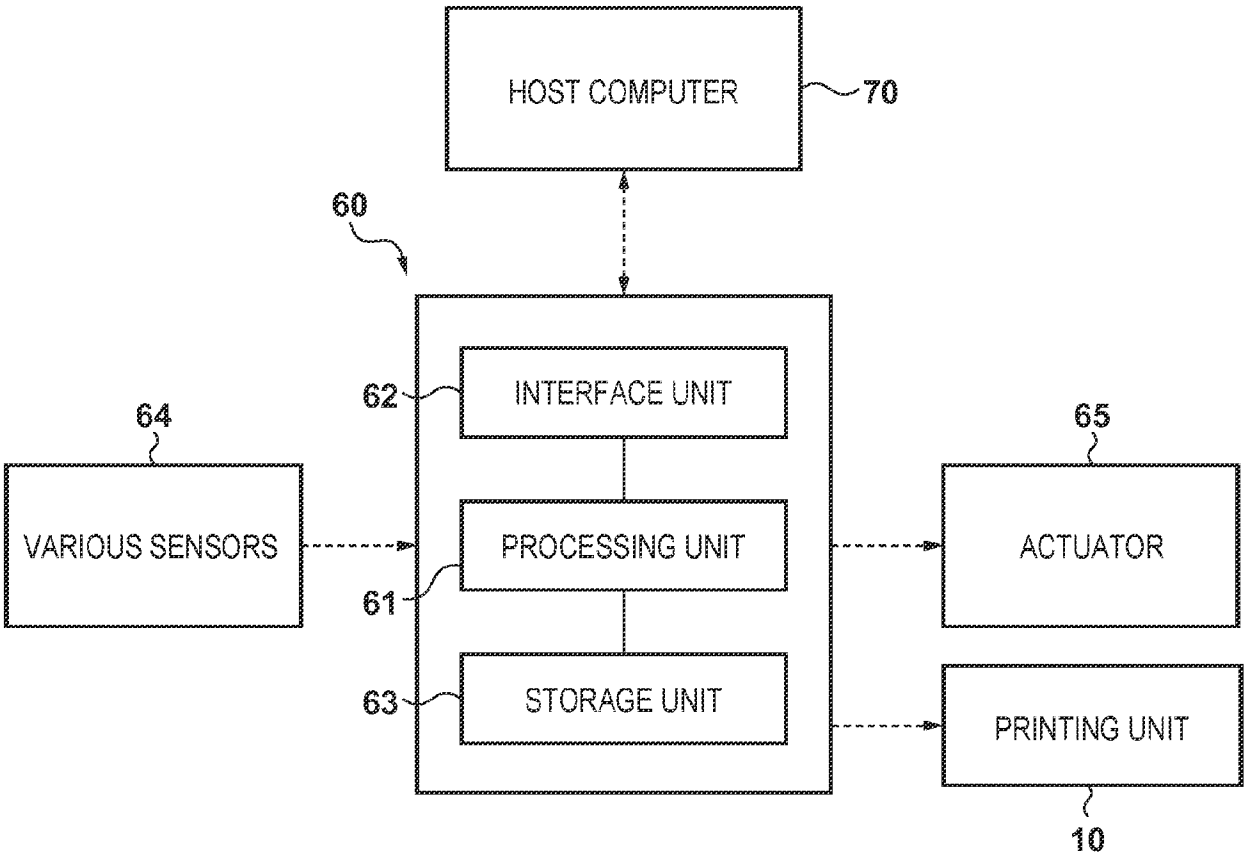
FIG. 5 is a block diagram showing a control unit.

FIG. 5 is a block diagram showing the control unit 60 of the printing apparatus 1. The control unit 60 includes a processing unit 61 such as a CPU, an interface unit 62 that exchanges data with an external device, and a storage unit 63 including a ROM and RAM. The processing unit 61 loads a program stored in the storage unit 63, and executes it to control the overall printing apparatus 1.

Arithmetic processes to be performed by the processing unit 61 include, for example, an image process, and a communication process with a host computer 70 via the interface unit 62. Arithmetic processes to be performed by the processing unit 61 also include, for example, discharge control of the printing unit 10 that is performed based on the detection results of various sensors 64 such as the remaining ink detection sensor S, and driving control of an actuator 65 for various motors and the like. The sensors 64 include a sensor that detects the position of the carriage 30, and sensors that detect the rotation amounts of the conveyance motor and pump unit 22, in addition to the remaining ink detection sensor S. The detection of the position of the carriage 30 can be performed using, for example, an encoder scale that is stationarily arranged and extends in the main scanning direction, and an encoder sensor mounted on the carriage 30. The detection of the driving rotational speed as the rotation amount of the pump unit 22 can be performed by, for example, a rotation angle sensor provided on a driving motor that drives the pump unit, and a controlled variable for controlling the driving motor. The actuator 65 includes even a carriage motor and a conveyance motor.

A cleaning process of executing the above-described recovery operation will be explained with reference to FIGS. 6 and 7. The cleaning process is a control process of performing the recovery operation including suction, preliminary discharge, and wiping, in order to maintain especially the performance of the orifices of the printing unit 10 when the printing apparatus 1 has not been used for a predetermined long period, or when the printing apparatus 1 has been used successively a predetermined number of times. Cleaning conditions as conditions to execute the cleaning process are not limited to the above-described ones. Other cleaning conditions are, for example, a case in which the time elapsed from the final use time or the final suction time exceeds a threshold upon receiving a print instruction, and a case in which the used dot count exceeds a threshold. Another cleaning condition is, for example, a state in which a cleaning flag is set to be ON when the ink tank 11 is exchanged or when a trouble such as detection of an abnormal end occurs during printing and the printing apparatus is reactivated.

Figure 6:
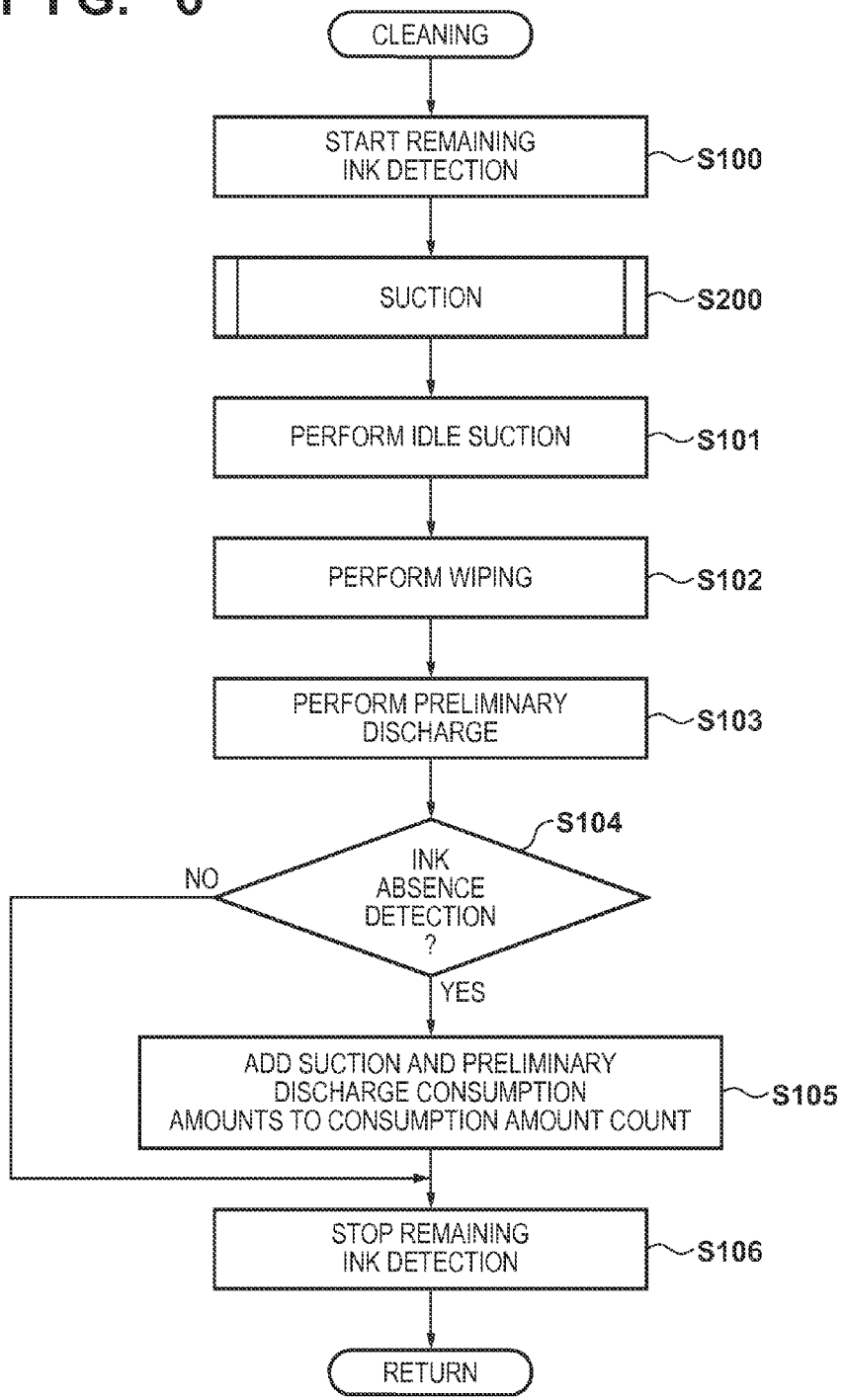
FIG. 6 is a flowchart showing an example of a process by the control unit.
Figure 7:
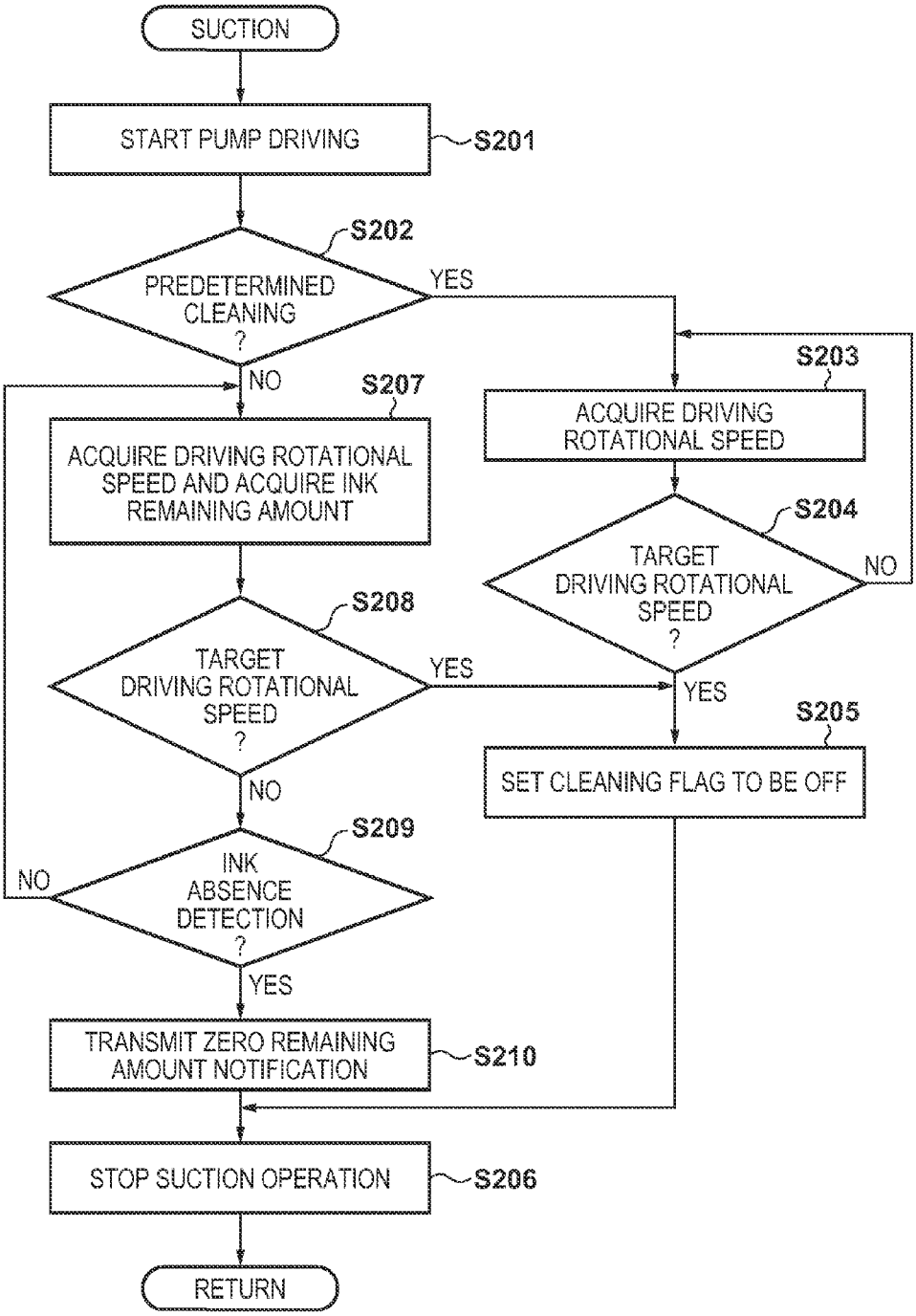
FIG. 7 is a flowchart showing an example of a suction process.

FIG. 6 is a flowchart showing a cleaning process, and FIG. 7 is a flowchart showing a suction process during the cleaning process. This cleaning process is activated at the timing when the above-mentioned cleaning condition is established and the cleaning flag is set to be ON. As described above, the control unit 60 of the printing apparatus 1 moves the printing unit 10 to above the recovery unit 20 to cap the printing unit 10 with the cap 23. In this process, detection of an ink remaining amount starts as a detection operation of detecting the ink remaining amount of the sub-tank 15. In step S100, a remaining ink detection start process is performed. The remaining ink detection sensor S acquires a voltage value at an interval of, for example, 200 msec by detection using the electrode pins. If voltage values acquired successively twice are equal to or larger than a threshold, the remaining ink detection sensor S determines that the ink remaining amount is equal to or smaller than the predetermined residual amount. However, the detection interval and the number of times are not limited to them.

In step S200, the suction process is performed as the suction operation. The suction operation will be explained in detail with reference to FIG. 7. The suction operation starts by driving the pump unit 22 (to be sometimes referred to as a pump hereinafter) in step S201 in a state in which the cap 23 abuts against the discharge surface 13 of the printing unit 10. Note that the suction operation is an operation of sucking ink in a predetermined suction amount. The amount of ink to be sucked is properly set in accordance with the cleaning process and the suction operation in progress. Suction control is performed on condition of whether the driving rotational speed of the pump has reached a target driving rotational speed, as a condition to complete suction in the predetermined suction amount.

In step S202, it is determined whether the cleaning process in progress is predetermined cleaning having a predetermined condition. Then, suction determination of whether suction exploits subsequent ink remaining amount detection is performed. Here, the method of determining predetermined cleaning is based on the condition that the ink consumption amount for cleaning is equal to or smaller than the capacity of the ink chamber 15*a* of the sub-tank 15. In this embodiment, whether to execute predetermined cleaning is determined in accordance with the cleaning condition. For example, when the cleaning condition is the above-described case in which the printing apparatus 1 has been used successively, predetermined cleaning with a small ink consumption amount is executed. For example, when the cleaning condition is the above-described case in which the printing apparatus 1 has not been used for a long period, cleaning using a large ink consumption amount is requested, so the predetermined cleaning is not executed. Note that whether to execute the predetermined cleaning is not limited to one determined in accordance with the above-described cleaning condition, and can be set appropriately. In this embodiment, the timing to determine the predetermined cleaning is set after pump driving in step S201, but may be set before the start of pump driving.

If the result of determination in step S202 is YES representing the predetermined cleaning, a loop of acquiring the driving rotational speed of the pump in step S203, and determining in step S204 whether the driving rotational speed of the pump has reached a target one is repeated. Since the time when a negative pressure was supplied into the tube 21 can be detected by acquiring the driving rotational speed of the pump, the discharge amount of ink sucked via the cap 23 can be estimated. If it is determined in step S204 that the driving rotational speed of the pump has reached a target one, it is considered that suction in the predetermined suction amount is completed and the suction operation is completed. Thus, the cleaning flag is set to be OFF in step S205, and the suction operation is stopped in step S206. The suction stop is, for example, the stop of the pump unit 22. However, the timing to set the cleaning flag to be OFF is not limited to this, and is arbitrary timing after step S204.

If the result of determination in step S202 is NO representing no predetermined cleaning, the driving rotational speed of the pump until now and the ink remaining amount detection result of the sub-tank 15 are acquired in step S207, and it is determined in step S208 whether the rotational speed of the pump has reached a target one. If the result of determination in step S208 is YES representing that the rotational speed of the pump has reached a target one, it is considered that the suction operation is completed, and the cleaning flag is set to be OFF in step S205, and the suction operation is stopped in step S206.

If it is determined in step S208 that the rotational speed of the pump has not reached a target one, it is determined in step S209 whether it has been detected that the ink remaining amount of the sub-tank 15 is equal to or smaller than the predetermined residual amount (to be also referred to as ink absence detection hereinafter). If NO representing, based on the detection result, that the ink absence detection has not been performed in step S209, the process returns to step S207 to repeat this determination loop. If the result of determination in step S209 is YES representing that the ink absence detection has been performed, a zero ink remaining amount notification that the ink remaining amount becomes 0 is transmitted to the control unit 60 in step S210, and the suction operation is stopped in step S206. Upon receiving the zero ink remaining amount notification, the control unit 60 stores it in the storage unit. The zero ink remaining amount notification is, for example, a notification which notifies the user that ink in the ink tank 11 runs out, and which prompts the user to perform, for example, exchange of the ink tank 11 and a return operation after the exchange. After performing exchange of the ink tank 11 or the like, the zero ink remaining amount notification to the user is canceled.

If the suction operation is stopped, that is, the suction operation is interrupted after the ink absence detection in step S209, it is considered that suction in the predetermined suction amount is not completed in the current suction operation, and the cleaning flag remains ON. This aims not to generate an image failure at the time of next printing because recovery of the ink supply channel or orifices for which the suction operation is not completed becomes insufficient. The time of next printing is, for example, a case in which the ink tank 11 is exchanged and the ink remaining amount is increased and recovered, or a case in which the printing apparatus is reactivated. It is also possible to inhibit printing until the state in which the zero ink remaining amount notification has been transmitted is canceled.

Referring again to FIG. 6, after the completion of the suction operation in step S200, idle suction in step S101 is executed. Note that "idle suction" in this specification is suction that is performed without causing the cap 23 to abut against the printing unit 10, or suction that is performed in an air communication state while causing the cap 23 to abut against the printing unit 10. This idle suction can discharge ink remaining in the cap 23 and the tube 21. In step S102, the wiper blade 24 wipes and cleans ink that has been attached to the printhead 14 of the printing unit 10 in the ink suction operation. In step S103, a preliminary discharge operation is executed to discharge high-viscosity ink or color-mixed ink that has been mixed in the orifices by the suction operation and the wiping operation. Note that steps S101 to S103 are executed even when ink absence detection in the sub-tank 15 is performed in step S209 and suction is interrupted in step S206.

In step S104, it is determined whether ink absence detection of the sub-tank 15 has been performed after suction in step S200. If the result of determination is YES representing that ink absence detection has been performed during the cleaning process, dot counting of an ink consumption amount in the sub-tank is started, and ink consumption amounts in the suction operation and preliminary discharge are added to the sub-tank consumption amount count in step S105. Even when ink absence detection in the sub-tank 15 is performed in step S209 and suction is interrupted in step S206, all the consumption amount until suction is interrupted is similarly added as the suction consumption amount. Finally, the ink remaining amount detection of the sub-tank 15 is stopped in step S106, completing the cleaning process.

In the above-described cleaning process, whether to execute predetermined cleaning is determined in the early stage. If the ink suction amount is small and not all ink in the sub-tank 15 is used up in the predetermined cleaning, the predetermined cleaning is executed without performing the remaining ink detection process. By this operation, ink in the ink tank 11 can be used up, and printing can be continued using ink in the sub-tank 15 even after the completion of suction. Further, entrapment of bubbles in the ink supply channel can be prevented. When not the predetermined cleaning but a suction operation with a large ink suction amount is executed, the ink remaining amount of the sub-tank 15 is detected successively during the suction operation. If it is detected that the ink remaining amount becomes equal to or smaller than the predetermined residual amount, the suction operation is interrupted. This can prevent entrapment of bubbles in the ink supply channel, and obviate the necessity to refill the ink supply channel at the time of exchanging the ink tank 11.

Since the suction operation is not stopped till the start of consuming ink in the ink chamber 15*a* of the sub-tank 15, unused ink in the ink tank 11 can be used up. As a result, entrapment of air in the ink supply channel can be prevented, and efficient maintenance of the printing unit 10 can be performed. Further, the printing apparatus 1 in which the residual ink amount of unused ink in the ink tank 11 is decreased can be provided.

Second Embodiment

Figure 8:
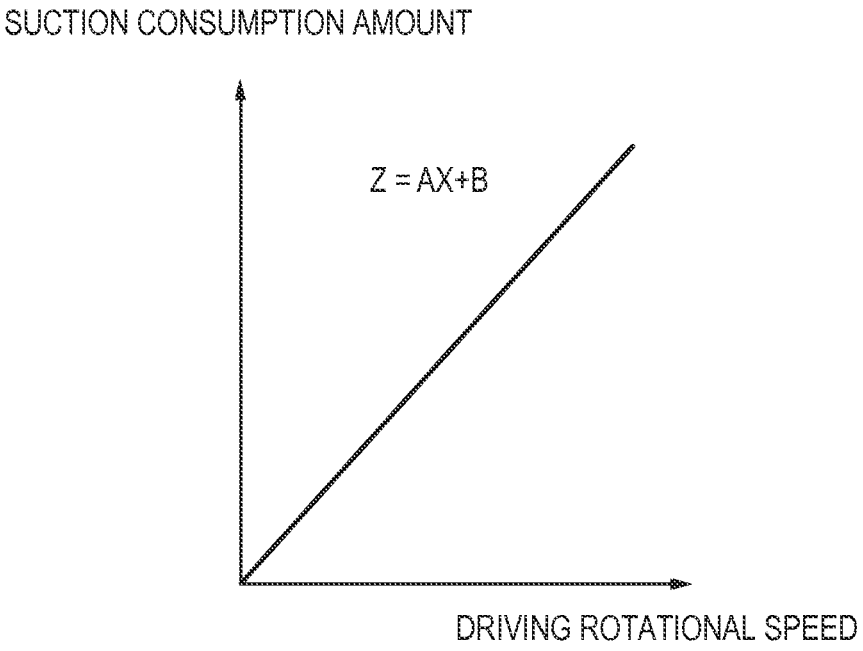
FIG. 8 is a graph showing the relationship between the suction consumption amount and the driving rotational speed of a pump.

The second embodiment according to the present invention will be described with reference to FIGS. 8 and 9. The second embodiment describes an example of another process in the suction operation of step S200 during the cleaning process according to the first embodiment. The second embodiment concerns a form in which the ink consumption amount by the suction operation is used up more efficiently by using the driving rotational speed of the pump upon detecting that the ink remaining amount is equal to or smaller than the predetermined residual amount.

In a printing apparatus 1, if it is detected that the ink remaining amount in a sub-tank 15 is equal to or smaller than the predetermined residual amount, and suction is interrupted, recovery of the orifices or ink supply channel by suction becomes insufficient. Thus, the interrupted suction operation needs to be executed again. However, if the suction operation is performed from the beginning, ink consumed by the suction operation till the interruption is wasted. Thus, when it is detected during the suction operation that the ink remaining amount of the sub-tank 15 is equal to or smaller than the predetermined residual amount, an estimated suction amount till the detection is calculated from the driving rotational speed of the pump, and an not-yet sucked-out amount which is an amount remaining till the predetermined suction amount of the completion of suction is sucked out is calculated. If this not-yet sucked-out amount is smaller than the capacity of an ink chamber 15*a* of the sub-tank 15 (a predetermined amount), it is determined that suction can be continued, and the suction operation can be executed without wasting ink, as described above.

The estimated suction amount will be explained with reference to FIG. 8. FIG. 8 shows the relationship between the suction consumption amount and the driving rotational speed of the pump. The abscissa indicates the driving rotational speed of the pump, and the ordinate indicates the suction consumption amount. Letting X be the driving rotational speed of the pump, an estimated suction amount Z of the suction operation is given by:

$$Z=AX+B \tag{1}$$

where A and B are the constants which arbitrarily change depending on the type of the cleaning process. Thus, the suction consumption amount in FIG. 8 is regarded as the estimated suction amount. When ink absence detection is performed, if the driving rotational speed of the pump at this time is acquired, the suction consumption amount upon detection can be calculated based on equation (1). Letting S be the target suction amount serving as a suction amount planned for a given suction operation, a necessary not-yet sucked-out amount after detection can be represented by S−Z and can be calculated. Note that B in equation (1) indicates the prediction of a suction consumption amount in which ink will be consumed until the driving rotational speed of the pump increases up to a predetermined rotational speed detectable by an encoder or the like. In FIG. 8, B=0.

Figure 9:
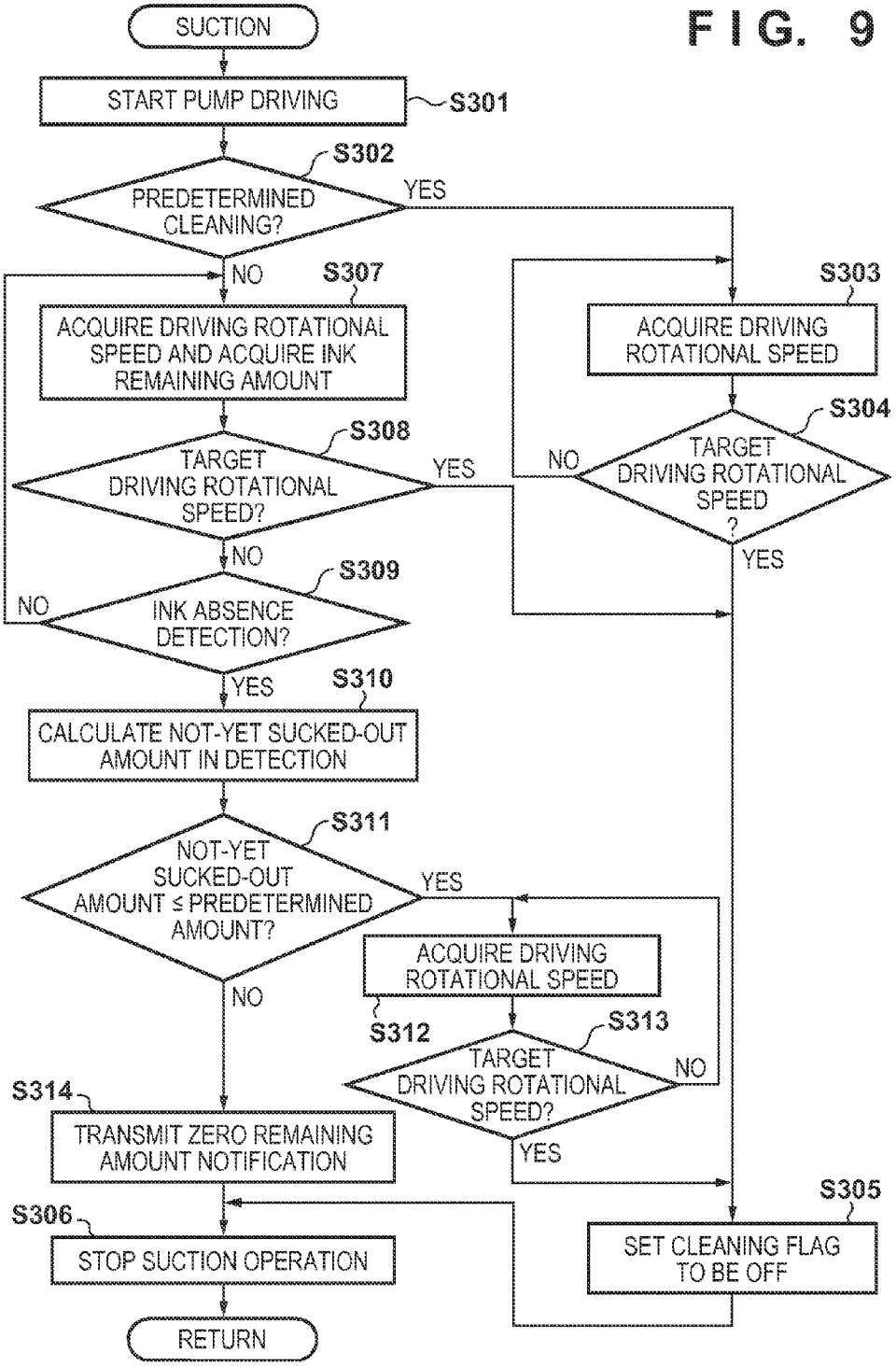
FIG. 9 is a flowchart showing another example of the suction process.

FIG. 9 is a flowchart showing a suction operation according to the second embodiment. Processes in steps S301 to S309 and S314 are the same as the processes in steps S201 to S210 shown in FIG. 7 according to the first embodiment, and a description thereof will not be repeated.

If the result of determination in step S309 is YES representing that the ink remaining amount is equal to or smaller than the predetermined residual amount, a not-yet sucked-out amount is calculated in step S310. It is determined in step S311 whether the not-yet sucked-out amount calculated in step S310 is smaller than a predetermined amount. The predetermined amount is a value obtained by adding an error of the suction & discharge amount to a remaining amount in the sub-tank 15 at the time of ink absence detection. The error of the suction & discharge amount considers, for example, the discharge amount of ink that is discharged by preliminary discharge to be executed after the suction process. If the result of determination in step S311 is YES representing that the not-yet sucked-out amount is equal to or smaller than the predetermined amount, pump driving is continuously executed. If it is determined in step S313 that the driving rotational speed has reached a target one, a cleaning flag is set to be OFF in step S305, and the suction operation is stopped in step S306. If the result of determination in step S311 is NO representing that the not-yet sucked-out amount exceeds the predetermined amount, a zero ink remaining amount notification is performed in step S314, and the suction operation is stopped in step S306.

Third Embodiment

The third embodiment according to the present invention will be described with reference to FIG. 10. The third embodiment concerns a form in which the driving rotational speed of the pump upon interrupting the suction operation during the cleaning process is used to improve the ink consumption amount counting accuracy of a sub-tank 15, and more efficiently use up the ink consumption amount by the suction operation.

First, the estimated suction amount Z of ink consumed till interruption when interruption of the suction operation is executed is calculated, as in the second embodiment described with reference to FIGS. 8 and 9. As for the estimated suction amount Z, a suction consumption amount of ink consumed till interruption can be calculated from the driving rotational speed of the pump. As the calculation method, the estimated suction amount Z can be calculated based on equation (1), as in the second embodiment. Letting S be the target suction amount serving as a suction amount planned for the suction operation, a suction amount necessary for additional cleaning necessary after interruption of the suction operation can be represented by S−Z. Hence, a driving rotational speed X' of the pump necessary to discharge ink by the necessary suction amount S−Z after interruption of the suction operation is given by:

$$X'=(S-Z-B)/A \quad (2)$$

Figure 10:
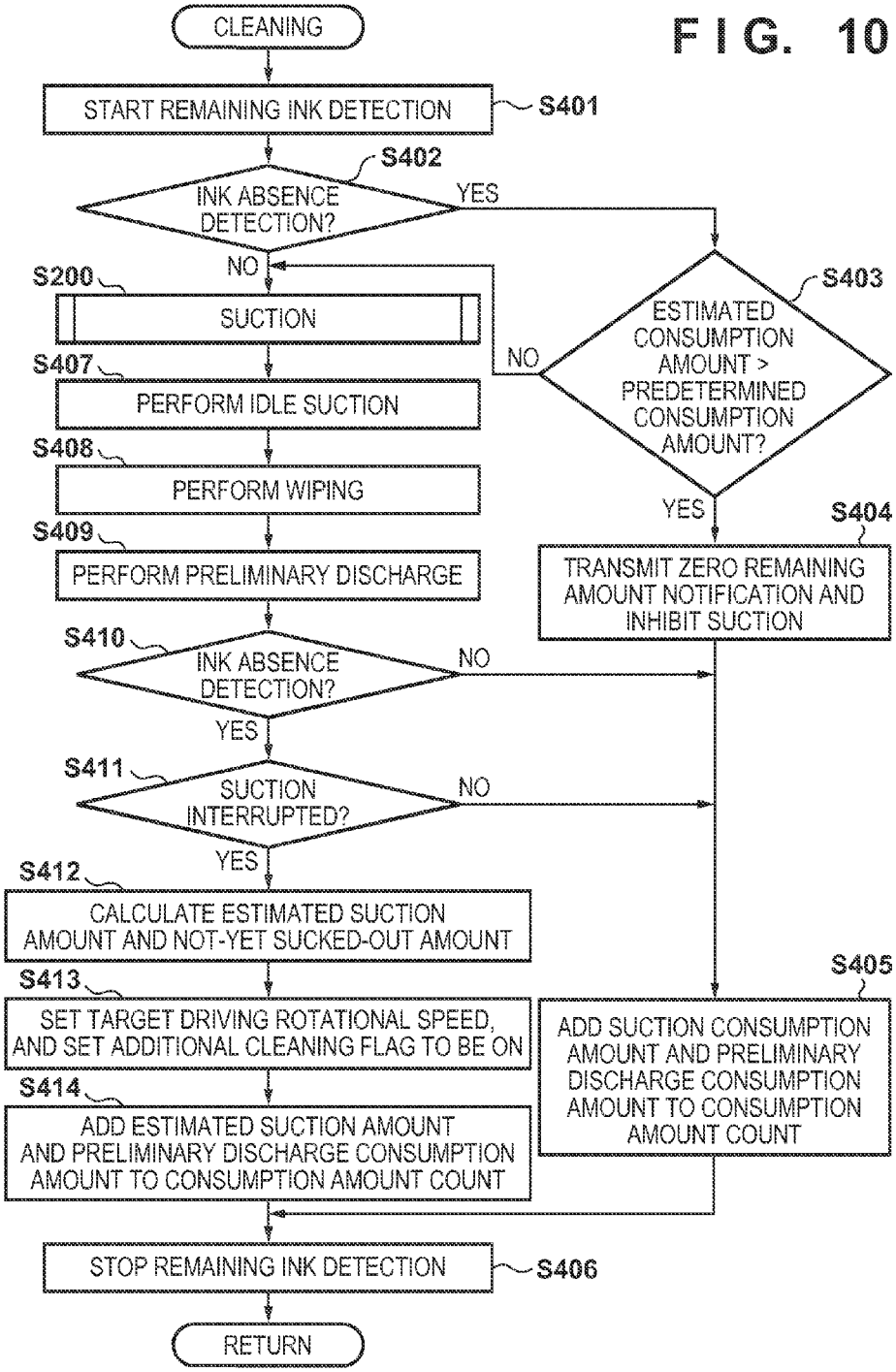
FIG. 10 is a flowchart showing an example of another process by the control unit.

FIG. 10 is a flowchart showing a cleaning process according to the third embodiment. Processes in steps S401, S200, and S406 to S410 are the same as the processes in steps S100 to S106 and step S200 shown in FIG. 6 according to the first embodiment, and a description thereof will not be repeated. Note that the third embodiment exemplifies, as a suction operation, the suction operation in step S200 according to the first embodiment. However, the suction operation is not limited to this, and the suction operation that is shown in FIG. 9 and used in the second embodiment may be employed.

After the start of detecting the remaining amount of the sub-tank 15 in step S401, it is determined in step S402 whether it has been detected that the ink remaining amount of the sub-tank 15 is equal to or smaller than the predetermined residual amount. If the result of determination in step S402 is YES representing that the ink absence detection has been performed, it is determined in step S403 whether the estimated consumption amount of the sub-tank 15 exceeds a predetermined consumption amount. The estimated consumption amount is the sum of the ink consumption amount of the sub-tank 15 and the consumption amount of cleaning in progress. The ink consumption amount of the sub-tank 15 is the consumption amount of ink consumed from the sub-tank 15 by executing a planned suction operation. The consumption amount of cleaning in progress is the consumption amount of ink consumed by preliminary discharge or the like after executing the suction operation. The predetermined consumption amount of the sub-tank 15 is the amount of ink contained in the sub-tank 15 at the time of ink absence detection of the sub-tank. That is, it is determined whether the consumption amount of ink consumed by the planned suction operation, preliminary discharge, and the like exceeds the amount of ink contained in the sub-tank 15.

If it is determined in step S403 that the condition is satisfied, the suction operation is inhibited in step S404, and the user is notified that the ink remaining amount is 0. Accordingly, whether to execute or inhibit the suction operation is determined in consideration of the ink remaining amount and the consumption amount, and entrapment of bubbles in the ink supply channel is prevented. However, when executing suction using a plurality of caps, for example, a Bk cap 23*a* and a Col cap 23*b*, it is also possible to normally execute the suction operation for ink of a cap not having undergone ink absence detection without executing the suction operation for only ink of a cap having undergone ink absence detection. After that, the suction consumption amount and the preliminary discharge consumption amount are added to the ink consumption amount count of the sub-tank 15 in step S405. Finally, in step S406, the detection of the ink remaining amount of the sub-tank 15 is stopped, completing the cleaning process. Since neither the suction operation nor preliminary discharge is performed this time, their values are not added.

If the condition is not satisfied in step S402 or the condition is not satisfied in step S403, it is determined in step S410 that ink absence detection has been performed. If NO representing that ink absence detection has not been performed, the suction consumption amount and the preliminary discharge consumption amount are added to the ink consumption amount count of the sub-tank 15 in step S405. Finally, in step S406, the detection of the ink remaining amount of the sub-tank 15 is stopped, completing the cleaning process. The ink remaining amount counting accuracy of the sub-tank 15 is therefore improved.

If YES in S410 representing that ink absence detection has been performed, it is determined in step S411 whether ink absence detection in the sub-tank 15 has been performed during the suction operation in the cleaning process and suction interruption has been executed. If the result of determination is YES representing that suction interruption has been executed, the process advances to step S412, and the estimated consumption amount and the not-yet sucked-out amount necessary for additional cleaning are calculated from the driving rotational speed of the pump, as described above. Thus, the ink consumption amount of the sub-tank 15 can be accurately obtained from the consumption amount of ink sucked till interruption. The suction consumption amount can be optimized by calculating the not-yet sucked-out amount necessary for additional cleaning, feeding it back to the next cleaning, and performing not-yet sucked-out control in the suction operation.

After that, based on the calculation result in step S412, the target driving rotational speed in additional cleaning is set as the next suction setting, and an additional cleaning flag is set to be ON in step S413. The additional cleaning flag is a flag for executing the suction operation in only the necessary not-yet sucked-out amount at the timing when suction inhibition is canceled after the ink remaining amount is increased and recovered by tank exchange or the like upon the end of the actual cleaning process. The suction operation is executed based on the target driving rotational speed set in step S413 at the time of next cleaning in accordance with this flag. Subsequently, in step S414, the estimated suction amount and the preliminary discharge consumption amount are added to the ink consumption amount count of the sub-tank 15. Finally, in step S406, the ink remaining amount detection of the sub-tank 15 is stopped, completing the cleaning process.

By the above-described cleaning process, in the case of suction in a small ink use amount, the suction is not interrupted, and printing can be performed continuously even after the completion of suction. Therefore, the residual ink amount of unused ink in an ink tank 11 can be decreased, and the sense of use by the user can be improved. As for suction in a large ink use amount, entrapment of bubbles in the ink supply channel can be prevented by interrupting suction, and refill of the supply channel at the time of ink tank exchange can be omitted. When ink remains in the ink tank 11, suction is permitted, so no ink remains in the ink tank 11. In addition, even when ink absence detection is performed during suction, continual suction is executed in consideration of the estimated suction amount till detection. By preventing the waste of ink and enabling continuous use, the sense of use by the user can be improved. Even when suction is interrupted, a not-yet sucked-out amount till the completion of suction in the predetermined suction amount after interruption can be set as the next suction recovery amount, preventing waste of ink. As a result, efficient maintenance of a printing unit 10 can be performed at the time of using up the ink tank 11, and the printing apparatus 1 with high sense of use by the user can be provided.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170892, filed Aug. 25, 2014, which is hereby incorporated by reference herein in its entirety.

What is claimed is:

1. A printing apparatus comprising:

a printhead configured to discharge ink;

a carriage on which the printhead is mounted and configured to be capable of moving;

a sub-tank configured to be mounted on the carriage and contain ink to be supplied to the printhead;

an ink tank configured to be detachably mounted on the carriage and contain ink to be supplied to the sub-tank;

a detection unit configured to perform a detection operation of detecting an ink remaining amount in the sub-tank;

a suction unit configured to perform a suction operation of sucking ink from the printhead; and a control unit configured to, after the detection unit detects that the ink remaining amount becomes smaller than a predetermined residual amount after the suction operation by the suction unit starts, stop the suction unit from performing the suction operation even if the suction operation has not been completed.

2. The apparatus according to claim 1, wherein the control unit calculates a not-yet sucked-out amount for suction of a predetermined suction amount, based on a detection result representing that the ink remaining amount becomes smaller than the predetermined residual amount during execution of the suction operation, and when the not-yet sucked-out amount exceeds a predetermined amount, stops the suction unit from performing the suction operation.

3. The apparatus according to claim 2, wherein when the not-yet sucked-out amount is smaller than the predetermined amount, the control unit causes the suction unit to continue the suction operation.

4. The apparatus according to claim 1, wherein when an ink suction amount which is necessary to complete the suction operation is larger than a capacity of the sub-tank, the control unit causes the suction unit to execute the suction operation based on the detection result of the detection unit, and when the ink suction amount is smaller than the capacity of the sub-tank, the control unit causes the suction unit to execute the suction operation without performing the detection operation.

5. The apparatus according to claim 1, wherein when the control unit stops the suction operation, the control unit calculates a not-yet sucked-out amount for suction of a predetermined suction amount, and sets the not-yet sucked-out amount as a suction amount of a next suction operation.

6. The apparatus according to claim 5, wherein the next suction operation is a suction operation that is performed after the ink remaining amount is recovered.

7. The apparatus according to claim 1, further comprising:

a preliminary discharge unit configured to cause the printhead to perform preliminary discharge after the suction operation; and a management unit configured to manage an ink consumption amount of the sub-tank, wherein when the control unit stops the suction operation, the management unit adds a discharge amount to the ink consumption amount of the sub-tank, the discharge amount being obtained by adding an amount discharged by the preliminary discharge to an estimated suction amount until the control unit stops the suction operation.

8. The apparatus according to claim 1, further comprising:

a preliminary discharge unit configured to cause the printhead to perform preliminary discharge after the suction operation; and an inhibition unit configured to inhibit execution of the suction operation when, before executing the suction operation, the ink remaining amount is smaller than a predetermined threshold and a discharge amount is larger than the predetermined threshold, wherein the discharge amount is obtained by adding an amount discharged by the preliminary discharge to a planned suction amount.

9. The apparatus according to claim 1, wherein the detection unit performs the detection operation by comparing a potential difference between a plurality of electrodes with a reference value.

10. The apparatus according to claim 1, wherein in at least one of a case in which the printing apparatus is not used for a predetermined period, a case in which the printing apparatus is used successively a predetermined number of times, a case in which the ink tank is exchanged, and a case in which the printing apparatus is reactivated, the control unit causes the suction unit to execute the suction operation.

11. The apparatus according to claim 1, wherein the suction unit is configured to be capable of performing a first suction operation of sucking ink of a first amount and a second suction operation of sucking ink of a second amount smaller than the first amount, the detection unit is configured to perform the detection operation during the suction unit performing the first suction operation, and the control unit is configured to stop the suction unit from performing the first suction operation when the detection unit detects that the ink remaining amount becomes smaller than the predetermined residual amount.

12. The apparatus according to claim 11, wherein the detection unit is configured not to perform the detection operation during the suction unit performing the second suction operation.

13. A method of controlling a printing apparatus including a printhead configured to discharge ink, a carriage on which the printhead is mounted and configured to be capable of moving, a sub-tank configured to be mounted on the carriage and contain ink to be supplied to the printhead, and an ink tank configured to be detachably mounted on the carriage and contain ink to be supplied to the sub-tank, the method comprising:

detecting an ink remaining amount in the sub-tank;

performing a suction operation of sucking ink from the printhead based on a detection result of the detecting; and stopping the suction operation after a detection result representing that the ink remaining amount becomes smaller than a predetermined residual amount after the suction operation starts even if the suction operation has not been completed.

14. The method according to claim 13, further comprising, after the step of detecting an ink remaining amount of the sub-ink tank:

calculating a not-yet sucked-out amount for suction of a predetermined suction amount, based on the detection result representing that the ink remaining amount becomes smaller than the predetermined residual amount during execution of the suction operation, wherein the step of stopping the suction operation is performed when the not-yet sucked-out amount exceeds a predetermined amount, and the step of performing the suction operation is continued when the not-yet sucked-out amount is smaller than the predetermined amount even if the detection result represents that the ink remaining amount becomes smaller than the predetermined residual amount.

15. The method according to claim 13, further comprising:

calculating a not-yet sucked-out amount for suction of a predetermined suction amount, when the suction operation is stopped in the suction stop step; and setting the not-yet sucked-out amount as a suction amount of a next suction operation.

16. The method according to claim 13, further comprising:

causing the printhead to perform preliminary discharge after the suction operation;

managing an ink consumption amount of the sub-tank; and adding a discharge amount to the ink consumption amount of the sub-tank when the suction operation is stopped in the step of stopping the suction operation, wherein the discharge amount is obtained by adding an amount discharged by the preliminary discharge to an estimated suction amount until the suction operation is stopped.

17. A method of controlling a printing apparatus including a printhead configured to discharge ink, a carriage on which the printhead is mounted and configured to be capable of moving, a sub-tank configured to be mounted on the carriage and contain ink to be supplied to the printhead, and an ink tank configured to be detachably mounted on the carriage and contain ink to be supplied to the sub-tank, the method comprising:

performing a suction operation of sucking ink from the printhead, wherein, when an ink suction amount which is necessary to complete the suction operation is larger than a capacity of the sub-tank, the method further comprises detecting an ink remaining amount in the sub-tank, and the suction operation is performed based on a detection result of the detecting, and stopping the suction operation after the detection result representing that the ink remaining amount becomes smaller than a predetermined residual amount after the suction operation has started, even if the suction operation has not been completed, and wherein, when the ink suction amount is smaller than the capacity of the sub-tank, the suction operation is performed without detecting the ink remaining amount in the sub-tank.

18. A non-transitory storage medium storing a program for causing a computer of a printing apparatus including a printhead configured to discharge ink, a carriage on which the printhead is mounted and configured to be capable of moving, a sub-tank configured to be mounted on the carriage and contain ink to be supplied to the printhead, and an ink tank configured to be detachably mounted on the carriage and contain ink to be supplied to the sub-tank, to execute the program, the program comprising:

causing a sensor to detect an ink remaining amount in the sub-tank;

causing a suction unit to perform a suction operation of sucking ink from the printhead based on a detection result of the causing the sensor to detect; and causing the suction unit to stop the suction operation after a detection result representing that the ink remaining amount becomes smaller than a predetermined residual amount after the suction operation starts even if the suction operation has not been completed.

* * * * *